United States Patent [19]

Anderson

[11] Patent Number: 4,928,449

[45] Date of Patent: May 29, 1990

[54] ELEVATED SUNDECK

[76] Inventor: Eugene Anderson, 3293 Stockland Rd., Battle Creek, Mich. 49017

[21] Appl. No.: 378,770

[22] Filed: Jul. 12, 1989

[51] Int. Cl.[5] ..... E04H 1/12

[52] U.S. Cl. ..... 52/194; 52/197; 52/263; 135/901

[58] Field of Search ..... 52/194, 197, 263, 19; 135/901, 117

[56] References Cited

U.S. PATENT DOCUMENTS

| | | | |
|---|---|---|---|
| 101,314 | 3/1870 | Sanders | 52/197 |
| 2,854,705 | 10/1958 | McClaran | 52/194 |
| 3,028,998 | 4/1962 | Malik et al. | 52/194 |
| 3,875,707 | 4/1975 | Horn | 52/263 |
| 4,606,142 | 8/1986 | Reneau | 52/263 |
| 4,719,716 | 1/1988 | Chrisley, Jr. | 52/263 |
| 4,823,529 | 4/1989 | Canfield et al. | 52/263 |

*Primary Examiner*—David A. Scherbel
*Assistant Examiner*—Caroline D. Dennison
*Attorney, Agent, or Firm*—H. Jay Spiegel

[57] ABSTRACT

The present invention relates to an improved deck device which is elevated with respect to associated structure. The device includes an elevated platform having sidewalls angled with respect to the horizontal. The sidewalls may be covered with a reflective covering designed to reflect the sun's rays in the direction of the center of the deck to facilitate tanning of individuals seated or lying thereon.

9 Claims, 2 Drawing Sheets

ELEVATED SUNDECK

BACKGROUND OF THE INVENTION

The present invention relates to an improved elevated sundeck. In the prior art, elevated structures are known and U.S. Pat. No. 2,854,705 to McClaran and U.S. Pat. No. DES. 196,735 to Grudoski teach such structures. In the inventions taught in each of these patents, however, the elevated support surface is completely shielded from the sun's rays by virtue of a roof structure. Applicant is not aware of any prior art teaching or suggesting the provision of an elevated deck device having angled walls with reflective surfaces allowing a person or persons to be situated on the elevated deck and to have the sun's rays reflected on them for the purpose of tanning, warming, etc.

SUMMARY OF THE INVENTION

The present invention relates to an improved elevated sundeck. The present invention includes the following interrelated aspects and features:

(a) In a first aspect, the present invention includes a deck surface elevated, by design, above adjacent structures. The purpose for this elevation is to provide a deck surface having a degree of privacy allowing the user to relax thereon, if desired, unclothed.

(b) The deck surface is surrounded by a plurality of walls which are inclined with respect to the horizontal. These walls may be covered with a reflective covering designed to reflect the sun's rays over the deck surface at an elevation where a person might sit or lie.

(c) A ladder may be provided allowing access to the deck surface through an opening therethrough which may, if desired, be closable through the use of a door which may, if desired, pivot between open and closed positions.

(d) The walls may be provided with air deflection means which may be adjusted to deflect air flowing over said walls in a desired direction.

Accordingly, it is a first object of the present invention to provide an improved elevated sundeck.

It is a further object of the present invention to provide such an improved elevated sundeck having a deck surface surrounded by walls which may have a reflective covering.

It is a yet further object of the present invention to provide such an improved elevated sundeck including air deflector means mounted on said walls.

It is a yet further object of the present invention to provide such a device having means allowing access to the deck surface including an opening therethrough which may, if desired, be closable for privacy.

These and other objects, aspects and features of the present invention will be better understood from the following detailed description of the preferred embodiments when read in conjunction with the appended drawings figures.

SPECIFIC DESCRIPTION OF THE PREFERRED EMBODIMENTS

Figure 1:
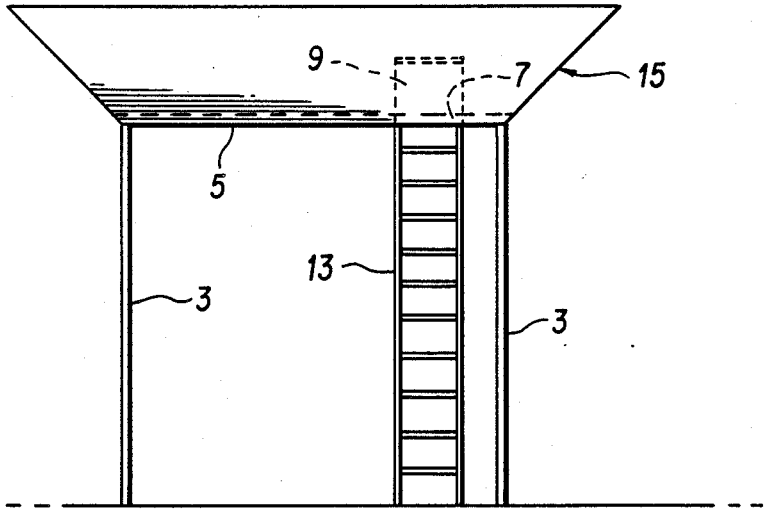
FIG. 1 shows a side view of the present invention.
Figure 2:
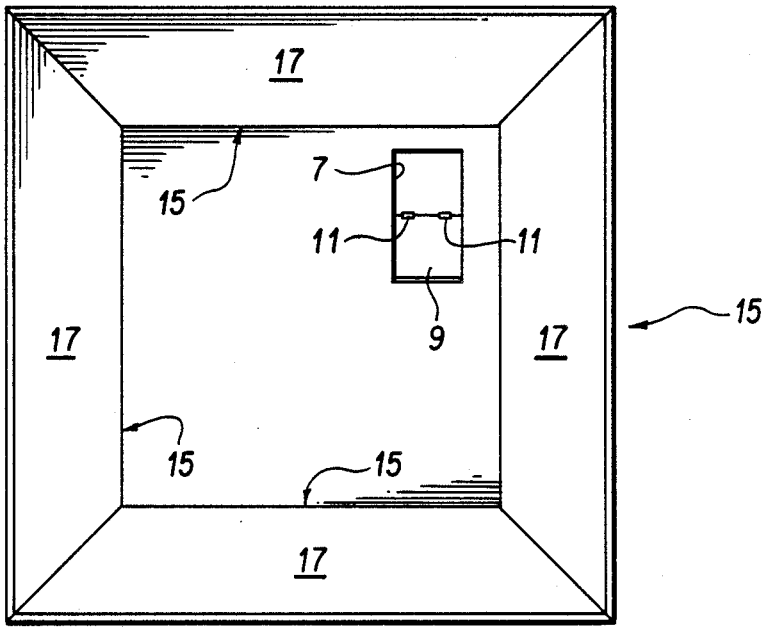
FIG. 2 shows a top view of the present invention.

With reference, firstly, to FIGS. 1 and 2, it is seen that the present invention is generally designated by the reference numeral 1 and includes support columns 3 supporting a deck surface 5 which may be made in a manner well known to those skilled in the art. The deck surface may include a plurality of planks mounted together using a frame structure or may be placed through any known construction technique.

With reference to FIG. 2, it is seen that an opening 7 is formed in the deck surface 5 which, if desired, may be closed by a door 9 pivoting on hinge 11.

A ladder 13 is provided allowing a user to climb up and thence through the opening 7 to arrive at the deck surface 5.

Figure 3:
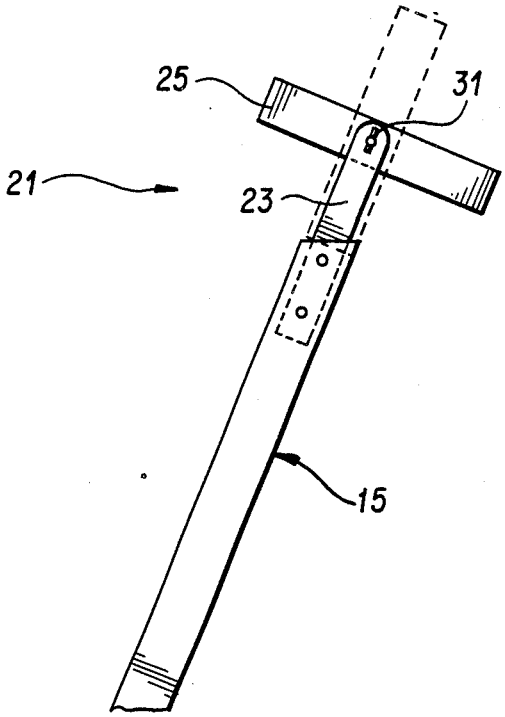
FIG. 3 shows a further side view showing a deflector means for deflecting air flowing over the walls of the invention.

Surrounding the deck surface 5 are a plurality of sidewalls 15 which, as best seen in FIGS. 1 and 3, are inclined to the horizontal. Each of the sidewalls 15 may have a reflective covering 17 thereon which may be created through the use of reflective paint, reflective tape, reflective metallic sheets, or any other reflective substance or device.

Figure 4:
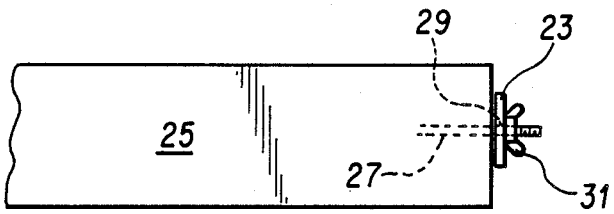
FIG. 4 shows a top view of the aspect shown in FIG. 3.

With reference to FIG. 3, some or all of the walls 15 may have mounted thereon an air deflector 21. The air deflector 21 may have supports 23 on which, are pivotably mounted, a deflector 25. The deflector has rods 27 extending from the ends thereof which respectively extend through openings 29 in the supports 23. The ends of the rods 27 may be threaded so that they can threadably receive wring nuts 31, which nuts may be tightened against the sides of the supports 23 to fix the angular position of the deflector 25. FIG. 4 shows a top view of the deflector 25 and associated structure.

As such, an invention has been disclosed in terms of a preferred embodiment thereof which fulfills each and every one of the objects of the invention as set forth hereinabove and provides a new and improved elevated sundeck which may be used by persons desiring to sunbathe or lounge or otherwise relax without inhibition.

Of course, various changes, modifications and alterations in the teachings of the present invention may be contemplated by those skilled in the art without departing from the intended spirit and scope thereof. For example, any desired devices may be placed on the deck surface 5 such as, for example, lounge chairs, spas, or other devices.

As such, it is intended that the present invention only be limited by the terms of the appended claims.

I claim:

1. An improved deck comprising:

(a) a decking having a deck surface; and (b) at least one side wall adjacent to said decking, said side wall being angularly related to said deck surface and having mounted thereon an angularly adjustable deflector.

2. The invention of claim 1, wherein said deck surface is elevated from a ground surface by support means extending from said decking to said ground surface.

3. The invention of claim 2, further including an access opening through said decking.

4. The invention of claim 3, further including a door closeable over said access opening.

5. The invention of claim 1, wherein said at least one sidewall comprises a plurality of sidewalls completely surrounding said deck surface.

6. The invention of claim 3, further including a ladder from said ground surface to said opening.

7. An improved deck comprising:

(a) a decking having a deck surface; and (b) at least one side wall adjacent to said decking, said side wall being angularly related to said deck surface and covered with a reflective covering.

8. The invention of claim 7, wherein said reflective covering comprises reflective paint.

9. The invention of claim 7, wherein said reflective covering comprises reflective material mounted over said side wall.

* * * * *